US005180175A

United States Patent [19]

Doolittle

[11] Patent Number: 5,180,175

[45] Date of Patent: Jan. 19, 1993

[54] DRILL CHUCK KEY

[76] Inventor: Mike Doolittle, 10 St. Paul St. Apt. 1, Grayslake, Ill. 60030

[21] Appl. No.: 659,221

[22] Filed: Feb. 22, 1991

[51] Int. Cl.[5] ..... B25B 13/44; B25B 13/46

[52] U.S. Cl. ..... 279/147; 81/16; 81/63

[58] Field of Search ..... 279/147, 1 K, 157; 81/16, 57, 39, 58, 58.2–58.4, 60–63.2, 467, 482, 483; 408/241 R

[56] References Cited

U.S. PATENT DOCUMENTS

| | | | |
|---|---|---|---|
| 4,386,879 | 6/1983 | Martinmaas | 408/241 R |
| 4,627,626 | 12/1986 | Rohm | 279/1 A |
| 4,627,628 | 12/1986 | Rohm | 279/20 |
| 4,781,083 | 11/1988 | Cumming | 279/147 X |
| 4,844,482 | 7/1989 | Rohm | 279/19 |

FOREIGN PATENT DOCUMENTS

| | | | |
|---|---|---|---|
| 3044090 | 9/1982 | Fed. Rep. of Germany | 279/147 |

*Primary Examiner*—Steven C. Bishop
*Attorney, Agent, or Firm*—Terry M. Gernstein

[57] ABSTRACT

A drill chuck key includes a bevel gear that is connectable with a collar of a drill to tighten or loosen the jaws of the drill and a mechanism for operating that bevel gear as the key is moved. The mechanism permits the tightening or loosening operation to be carried out using the same movement of the key, and prevents over- or under- tightening of the drill jaws. One form of the mechanism includes a double pawl engaging ratchet wheels one of which has at least one trip dog thereon so that identical oscillating motion of the key will impart tightening to the drill jaws and can also loosen those jaws. Another form of the mechanism includes epicyclic gearing.

3 Claims, 3 Drawing Sheets

DRILL CHUCK KEY

TECHNICAL FIELD OF THE INVENTION

The present invention relates to the general art of hand tools, and to the particular field of hand-held drills.

BACKGROUND OF THE INVENTION

Most drills are either manually operated, such as illustrated in FIG. 1, or power operated, such as illustrated in FIG. 2, and nearly all include an assembly D to hold a drill bit B to the handle H of the drill. This assembly generally includes a chuck C, a collar E and a jaw J into which the shank S of the drill bit fits. The jaw J is opened to receive the drill bit shank, and is then tightly closed onto that drill bit shank to attach the drill bit to the handle.

The jaws of the drill are opened and closed using a chuck key K, such as is illustrated in FIG. 3, that includes a bevel gear G and a handle CH. The handle is often connected to the bevel gear by a shank CS. The bevel gear G is inserted into receiving holes RH on the collar C and rotated to open and close the jaws of the drill.

The inventor has found that there are instances in which the jaws of the drill are either undertightened or overtightened and further instances when it is difficult or onerous to operate the drill jaws using a chuck key such as shown in FIG. 3.

For example, if the jaws are undertightened, the drill bit may not be securely fastened to the handle, which may give rise to a dangerous situation at worst, and to an inaccurate work operation at best. On the other hand, however, if the drill jaws are overtightened, time and effort is wasted and various elements of the drill may be subjected to unnecessary wear.

Still further, the chuck key such as illustrated in FIG. 3, must be turned one way to close the jaws, and the opposite direction to open the jaws. The inventor has also found that, in some situations, it is cumbersome or annoying to operate the chuck key in one direction or the other. This situation can occur when the drill is being used in a tight or special location or in a special orientation. Still further, keys such as shown in FIG. 3 are small and are prone to becoming lost or misplaced.

Accordingly, there is a need for a drill chuck key that is easy to use, and need be turned in only one manner to either tighten or loosen the jaws of a drill, yet will not be prone to overtightening or undertightening the drill jaws.

OBJECTS OF THE INVENTION

It is a main object of the present invention is to provide a drill chuck key that is easy to use.

It is another object of the present invention to provide a drill chuck key that is easy to use, and need be turned in only one manner to either tighten or loosen the jaws of a drill.

It is another object of the present invention to provide a drill chuck key that is easy to use, and need be turned in only one manner to either tighten or loosen the jaws of a drill, yet will not be prone to overtightening or undertightening the drill jaws.

SUMMARY OF THE INVENTION

These, and other, objects are achieved by a chuck key that includes a mechanism for preventing the overtightening of the drill chuck jaw, and which can automatically reverse its operation to open the jaw without requiring the user to reverse his hand movement.

In this manner, the drill chuck can be operated in an efficient and facile manner and will not over- or undertighten the drill chuck.

BRIEF DESCRIPTION OF THE DRAWING FIGURES

DETAILED DESCRIPTION OF THE PREFERRED EMBODIMENT OF THE INVENTION

Figure 1:
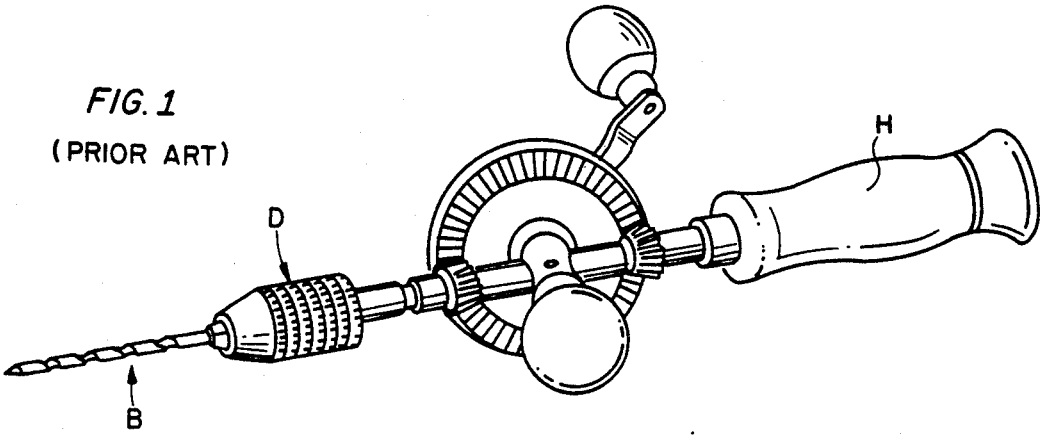
FIG. 1 (PRIOR ART)
FIG. 1 is a perspective view of a prior manually-operated hand drill.
Figure 2:
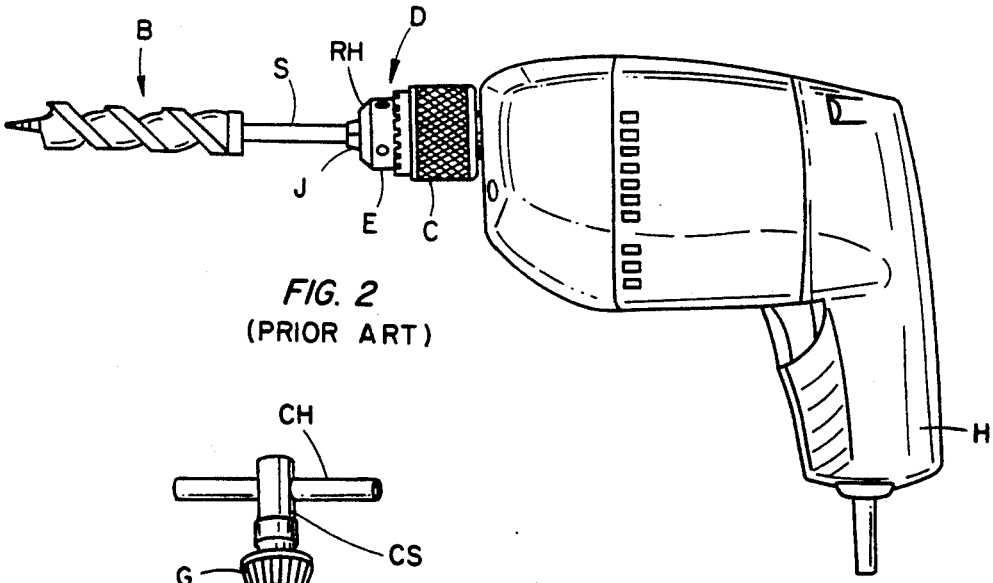
FIG. 2 (PRIOR ART)
FIG. 2 is a side elevational view of a prior art hand-held power drill.
Figure 3:
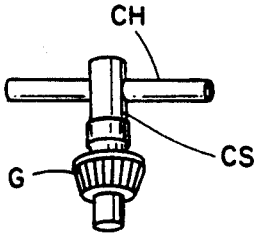
FIG. 3 (PRIOR ART)
FIG. 3 is a perspective view of a prior art chuck key.
Figure 4:
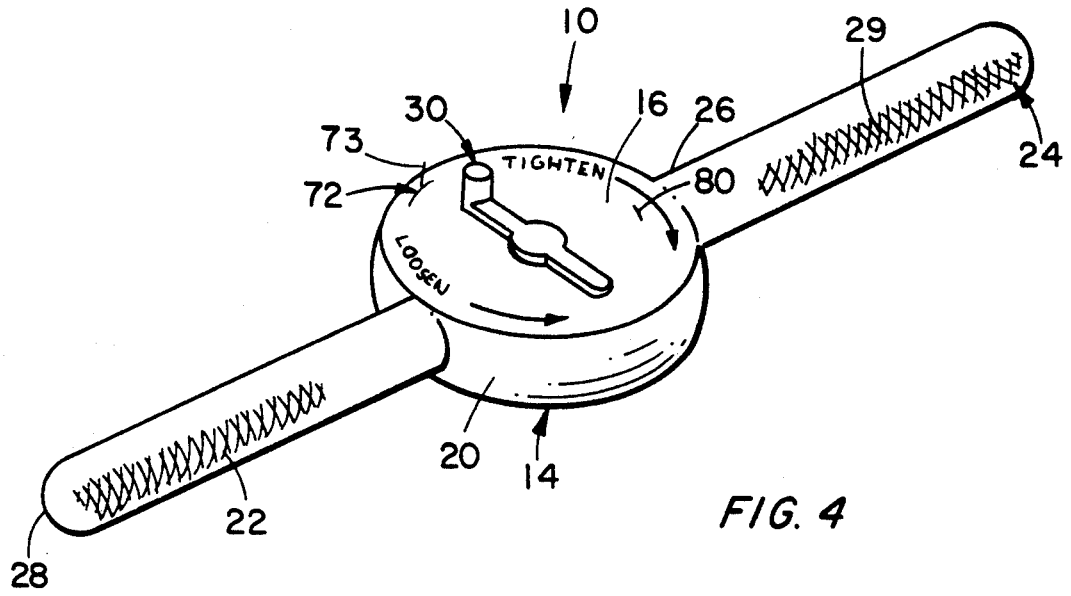
FIG. 4 is a top perspective view of a chuck key embodying the present invention.
Figure 5:
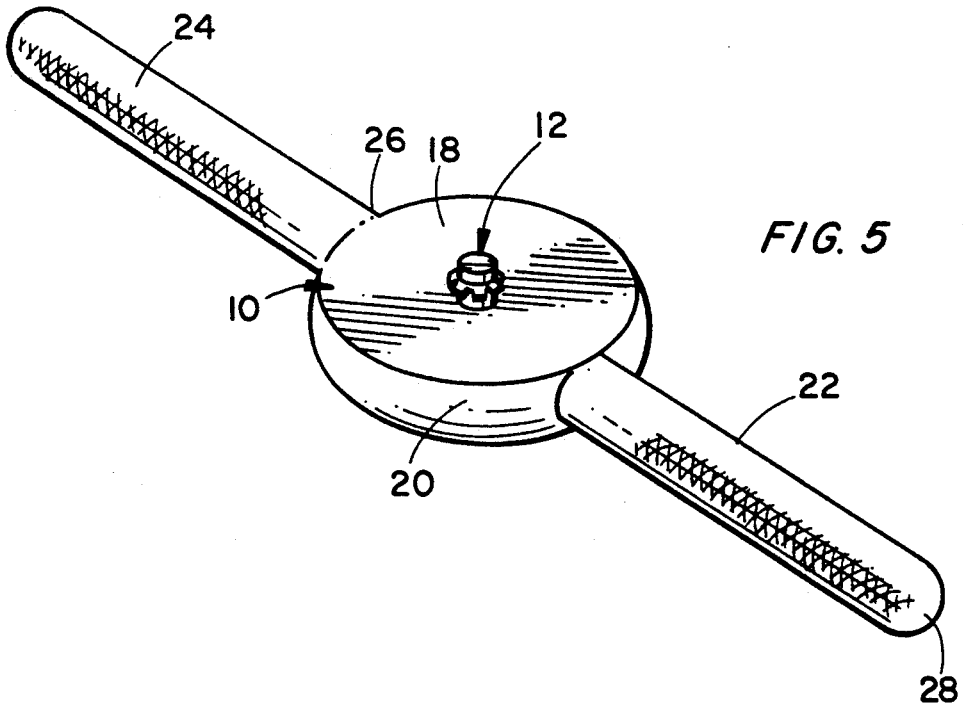
FIG. 5 is a bottom perspective view of a chuck key embodying the present invention.

Shown in FIGS. 4 and 5 is a chuck key 10 embodying the present invention. The chuck key 10 is used to tighten and loosen the jaws of a drill such as shown in FIGS. 1 and 2, and is operated by engaging a bevel gear 12 (identical to the bevel gear G shown in FIG. 3) with the collar C of the drill. The chuck key 10 will be operated in the same manner relative to the drill to both open or close the drill jaws, and will not over- or undertighten the jaws.

The key 10 is a one-piece unit and includes a hollow, circular central body 14 having a top surface 16 and a bottom surface 18 connected together by a peripheral wall 20. The central body is circular in shape and has a diameter extending through the gear 12 with the gear 12 being located at the center of the body 14. The key also includes two identical handles 22 and 24, each having a proximal end, such as end 26 of handle 24, connected to the peripheral wall 20, and a distal end, such as end 28 of handle 22 spaced from the wall. The handles are each axially aligned with each other and with a diameter of the central body, and each include knurling, such as knurling 29 on handle 24, adjacent to the distal end thereof. A switch 30 is also located adjacent to the top surface 16 and is rotatably mounted to be manually rotated to control the tightening and loosening operation of the drill chuck jaws as will be explained below.

As mentioned above, it has been found convenient to operate the chuck key in the same manner to both tighten and loosen the drill jaws, and it has been found desirable to ensure that those jaws are neither over- or under- tightened. Accordingly, the chuck key of the present invention includes a drill chuck operating mechanism whereby operation of the handles about the bevel gear 12 in the same manner will tighten the drill jaws when the switch is set in one position and will loosen the drill jaws when the switch is set in a second position; and will automatically stop tightening or loosening those jaws when a prescribed amount of rotation has occurred.

Figure 6:
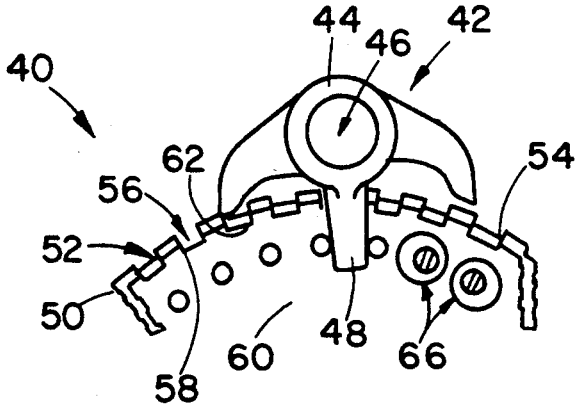
FIG. 6 illustrates one form of reversing mechanism used in conjunction with the chuck key of the present invention.

One form of this operating mechanism is shown in FIG. 6. The mechanism 40 shown in FIG. 6 includes a double pawl 42 having a body 44 connected to the central body by a shaft 46 fixedly attached to the central body to move with that body. The body 44 also includes a support arm 48.

The mechanism 40 is operated by oscillating the central body back and forth about the bevel gear 12 after that gear has been engaged in the drill chuck collar. The oscillating movement is identical to loosen or tighten the drill jaw, but loosening or tightening is achieved by setting the switch as above discussed. The mechanism 40 moves in one direction for a preset number of oscillations, and then automatically reverses direction. This can be used, for instance, to tighten the jaws to a predetermined degree, and to then automatically stop the tightening process, and even, begin a loosening process. The change in process will be accompanied by an audible signal which will alert the user that the desired process is completed. The audible signal is associated with one element of the mechanism contacting another element in the manner described below. If the user is not alerted by the audible signal, that user will notice a lessening of the force acting against the desired process and will be thus alerted that the desired process is completed. In the case of a loosening process, the signals may not be needed.

The mechanism 40 includes a disc 50 on which a driven ratchet 52 is located and on which the bevel gear 12 is mounted for rotation therewith. The driven ratchet includes a plurality of teeth, such as tooth 54, and one or more large teeth, such as tooth 56, that are larger than the teeth 54. The driven gear is moved by engagement of the ends of the double pawl in the teeth as the handle is oscillated. The ratchet is moved in a preset direction under the influence of the pawl. After a predetermined amount of movement of the driven ratchet, the mechanism 40 will automatically reverse.

Mounted concentrically with the driven ratchet is a smaller controlling ratchet 58 attached to a mounting disc 60. The mounting disc 60 is mounted on the central housing 14 by a shaft located centrally thereof. The disc is frictionally engaged on the shaft so that it will normally be restrained from rotating with respect to the housing 14 during oscillation of the key. The ratchet 58 includes a plurality of teeth 62. The ratchet 52 is larger in diameter than the ratchet 58 and the larger diameter of the driven ratchet prevents the pawl from engaging the smaller ratchet 58, except when the deep tooth 56 is reached by the pawl which then drops down into engagement with the smaller ratchet 58. This movement of the pawl into the smaller ratcht will be accompanied by an audible sound that will alert the user of the change in operation.

The reversal of motion is effected by the engagement of the extension support 48 of the pawl with one of a plurality of trip dogs 66 mounted on the disc 60. The number of revolutions or degree of movement of the ratchet 52 prior to reversal depends upon the number of deep teeth and the position of the trip dogs 66.

When the mechanism 40 is in operation, ratchet 52 receives an intermittent motion from key via the oscillating pawl 42 and the controlling ratchet 58 remains stationary with respect to the driven ratchet 52 until one of the deep teeth is engaged by the pawl 42; then ratchets 52 and 58 rotate together an amount depending upon the motion of the pawl. Finally, one of the trip dogs 66 is brought into contact with the support arm 48 which is then swung around so that its opposite end engages ratchet 52 and, consequently, the direction of rotation is reversed. The engagement of the trip dogs with the support arm will also generate an audible sound which will alert the user that operation may be stopped.

Alternatively, several trip dogs can be placed on the disc 60 to reverse movement of the bevel gear twice or more. The first time the reversal occurs, the user will be alerted that the operation is completed, and several more oscillations will reverse the direction until the second trip dog engages the pawl, at which time further movement of the key will reverse the just-reversed tightening or loosening operation to place the desired degree of tightening or loosening on the drill collar. The time of reversal is controlled by varying the distance between the trip dogs and by having one or more deep teeth in the driven ratchet. The initial tightening or loosening of the mechanism 40 is controlled by the setting of the switch which is connected to the pawl adjacent to the axle 46 and positions the pawl according to the setting of the switch.

Figure 7:
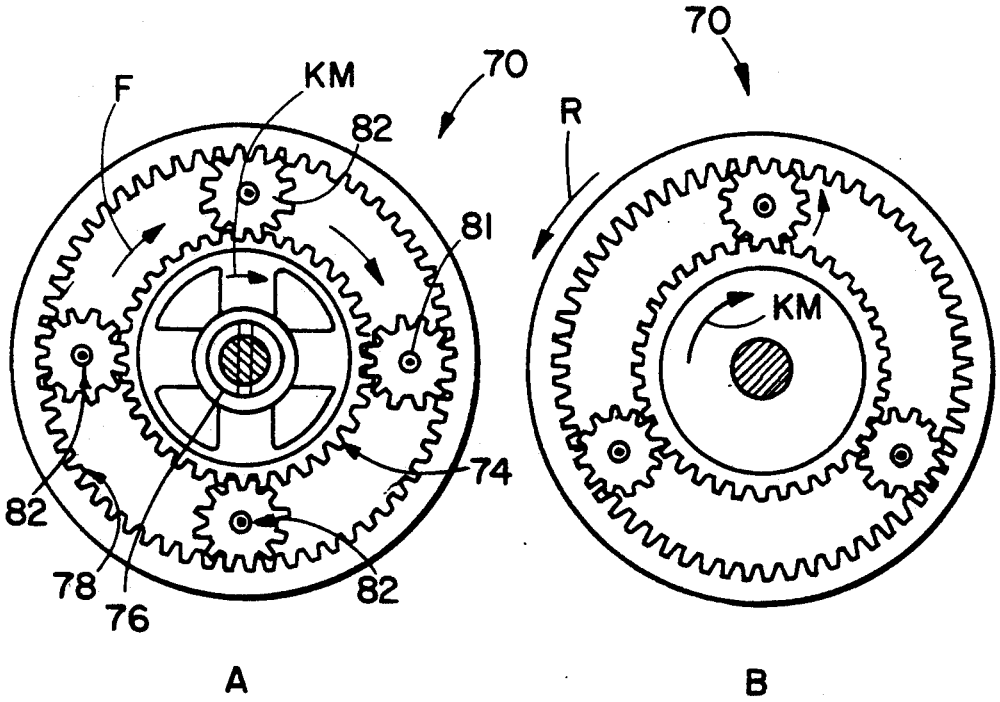
FIGS. 7A and 7B illustrate another form of reversing mechanism used in conjunction with the chuck key of the present invention.

Another form of the drive mechanism is shown in FIG. 7. The drive mechanism 70 shown in FIG. 7 permits the user to rotate the bevel gear in either the clockwise or the counterclockwise direction while rotating the key in only one direction. The drive mechanism 70 achieves this reversal of motion through epicyclic gearing. In the drive mechanism 70, a train of epicyclic or differential gearing is designed to give the reversal of motion. Two sets of differential gears are mounted inside drums located inside the housing 14. The drums may be revolved independently for obtaining slow forward speed and a reverse motion, or they may be locked together so as to revolve as a unit. The locking or unlocking of the drums is achieved using a switch on the housing 14, indicated at 72 in FIG. 4. The switch includes a movable lever 73 which moves a cam that moves an over-center lever on one drum over onto the other drum to lock the drums together. Reverse movement of the switch unlocks the drums by moving a catch on the switch lever arm against the over-center lever and moving it in the opening direction.

A central gear 74 is fixedly attached to an axle 76 for rotation therewith. The axle 76 is fixedly attached to the housing 14 for rotation therewith. The central gear 74 is a driver gear. A slow forward speed is obtained with the combination shown in A. To obtain a reduction in speed, internal gear 78 is held stationary with respect to the gear 76 by applying a brake thereto as operated by the switch 30. This switch is moved into a preset "braking" position B0 in which cams on the housing and on the axle associated with the switch align to force two plates together with the gear 78 sandwiched therebetween. Pinions 82 are carried by the driving gear 74 and are then forced by the driving gear to roll around inside of the internal gear thus transmitting a slow rotary motion to a driven member attaching the pinions to the bevel gear. The driven member is in the form of a funnel-shaped element attached at an upper rim of a conical end thereof to the pinions by axles, such as axle 81, and at a cylindrical portion thereof located at the apex of the conical portion to the bevel gear.

In order to obtain a reversal of bevel gear motion while continuing to rotate the key in the same direction, the switch 30 is rotated until it has moved to the "loosen" position. This movement causes the cam on the switch to move into a position adjacent to a cam connected to the housing 14 and which engages the driven member to sandwich the driven member between the switch cam and the housing cam thereby preventing the driven member from rotating. This movement of the switch also moves the switch mounted cam from adjacent to the cam on the gear 78 thereby freeing that gear to rotate. Now, rotation of the key rotates the driving gear 74, which causes the pinions to rotate about their axles and transmit the rotation directly to the gear 78. The funnel-shaped member associated with pinions 82 is attached at its cylindrical portion to the bevel gear via an overrunning clutch mechanism so that even though the pinions are not rotating about the drive shaft 76 in the forward direction, this member will not prevent the reverse movement of the bevel gear. The overrunning clutch will permit the pinions to transmit motion to the bevel gear when desired. In this configuration, the internal gear transmits motion to the bevel gear. The two directions of rotation are indicated in FIGS. 7A and 7B by arrows F and R respectively with the direction of key movement being indicated in both figures by the arrow KM.

It is understood that while certain forms of the present invention have been illustrated and described herein, it is not to be limited to the specific forms or arrangements of parts described and shown.

I claim:

1. A chuck key for tightening and loosening a drill chuck comprising:

A) a central hollow, cylindrical body having a top surface, a bottom surface and a peripheral wall connecting said top surface to said bottom surface, said central body having a center and a diameter extending through said center;

B) two handles, each connected at a proximal end thereof to said central body peripheral wall and having a distal end spaced from said peripheral wall, said handles being axially aligned with each other and with said central body diameter; and C) a drill chuck operating mechanism including (1) a reversing mechanism housed within said hollow circular body and including (a) a first gear connected to said central body for movement therewith, (b) a second gear mounted in said central body, and (c) means for engaging said first gear with said second gear to drive said second gear in conjunction with said first gear, (2) a selection switch connected to one of said first and said second gears, and (3) a bevel gear attached to at least one of said first and second gears for movement therewith and located at said central body center.

2. The chuck key defined in claim 1 wherein said first gear includes a double pawl element having a support arm.

3. The chuck key defined in claim 2 wherein said second gear includes a first ratchet wheel having a first diameter and a second ratchet wheel having a second diameter, said first diameter being larger than said second diameter, said first and second ratchet wheels each having a plurality of teeth, said means for engaging said first gear with said second gear including at least one tooth on said first ratchet wheel that is larger than adjacent teeth on said first ratchet wheel, and at least one trip mechanism on said second ratchet wheel, said first ratchet wheel being slidably mounted on said second ratchet wheel and said trip mechanism being located to engage said pawl element support arm, said bevel gear being mounted on said first ratchet wheel to rotate with said first ratchet wheel.

* * * * *